United States Patent [19]

Deutsch et al.

[11] Patent Number: 4,467,688

[45] Date of Patent: Aug. 28, 1984

[54] POLYPHONIC MUSICAL TONE GENERATOR

[75] Inventors: Ralph Deutsch, Sherman Oaks; Leslie J. Deutsch, Sepulveda, both of Calif.

[73] Assignee: Kawai Musical Instrument Mfg. Co., Ltd., Hamamatsu, Japan

[21] Appl. No.: 457,302

[22] Filed: Jan. 11, 1983

[51] Int. Cl.[3] ..... G10H 7/00

[52] U.S. Cl. ..... 84/1.01; 84/1.28

[58] Field of Search ..... 84/1.01, 1.03, 1.28

[56] References Cited

U.S. PATENT DOCUMENTS 3,763,364 10/1973 Deutsch et al. ..... 84/1.03 X 4,183,275 1/1980 Niimi et al. ..... 84/1.01

4,246,822 1/1981 Deutsch ..... 84/1.01

*Primary Examiner*—Stanley J. Witkowski

*Attorney, Agent, or Firm*—Ralph Deutsch

[57] ABSTRACT

A keyboard operated electronic musical instrument is disclosed which has a number of tone generators that are assigned to actuated keyswitches. The tone generation is produced by sequentially and repetitively accessing a memory containing a set of data points which define a period of a preselected musical waveshape. Apparatus is described whereby a plurality of tone generators are implemented by each one selecting data points read out of the memory in response to a comparison logic.

20 Claims, 5 Drawing Figures

POLYPHONIC MUSICAL TONE GENERATOR

BACKGROUND OF THE INVENTION

1. Field of the Invention

This invention relates to electronic musical tone synthesis and in particular is concerned with the generation of polyphonic tones in response to keyswitches actuated in an array of keyswitches.

2. Description of the Prior Art

Electronic keyboard musical instruments can be classified as either being monophonic or polyphonic tone generators. An instrument of the monophonic type is limited to generating only a single tone at one time. If more than one keyswitch is actuated simultaneously, all but one of the keyswitches is ignored so that only a single tone is generated. A polyphonic tone generator is an instrument capable of generating a plurality of tones in response to a corresponding actuation of keyswitches.

Digital tone generators that operate by having a stored waveshape consisting of a set of data points defining a single period of a musical waveshape can be implemented as a polyphonic musical instrument by having an independent memory means associated with each of a plurality of tone generators. These tone generators are assigned to actuated keyswitches. An instrument of this type is described in U.S. Pat. No. 4,085,644 entitled "Polyphonic Tone Synthesizer."

A single waveshape memory can also be shared between several tone generators. A system for utilizing a single waveform memory in a time shared, or multiplexing, fashion is described in U.S. Pat. No. 3,743,755 entitled "Method And Apparatus For Addressing A Memory At Selectively Controlled Rates." A calculator is used for continuously computing a set of numbers, each of which defines a different spacing between the addresses of the waveshape memory. The numbers calculated are each periodically increased by their own value and the individual results identify addresses for the waveshape memory. The numbers are used in turn to address the memory to obtain waveshape sample points corresponding to each of the several tone generators.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created. At the end of each computation cycle, the computed master data set is stored in a main register.

Following each computation cycle, a transfer cycle is initiated during which the stored master data set is transferred to a note register. The data stored in the note register is sequentially and repetitively read out at a fixed rate. A comparator is used to assign the read out data from the note register to each of a number of tone generators in response to the count state of a counter and an accumulated frequency number that is generated for each of the tone generators. The output tone generation continues uninterrupted during the computation and transfer cycles.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic tone generator in which a number of tone generators share waveshape data stored in a single note register. The polyphonic tone generator is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer or correspond to combinations of several elements appearing in the referenced patent.

Figure 1:
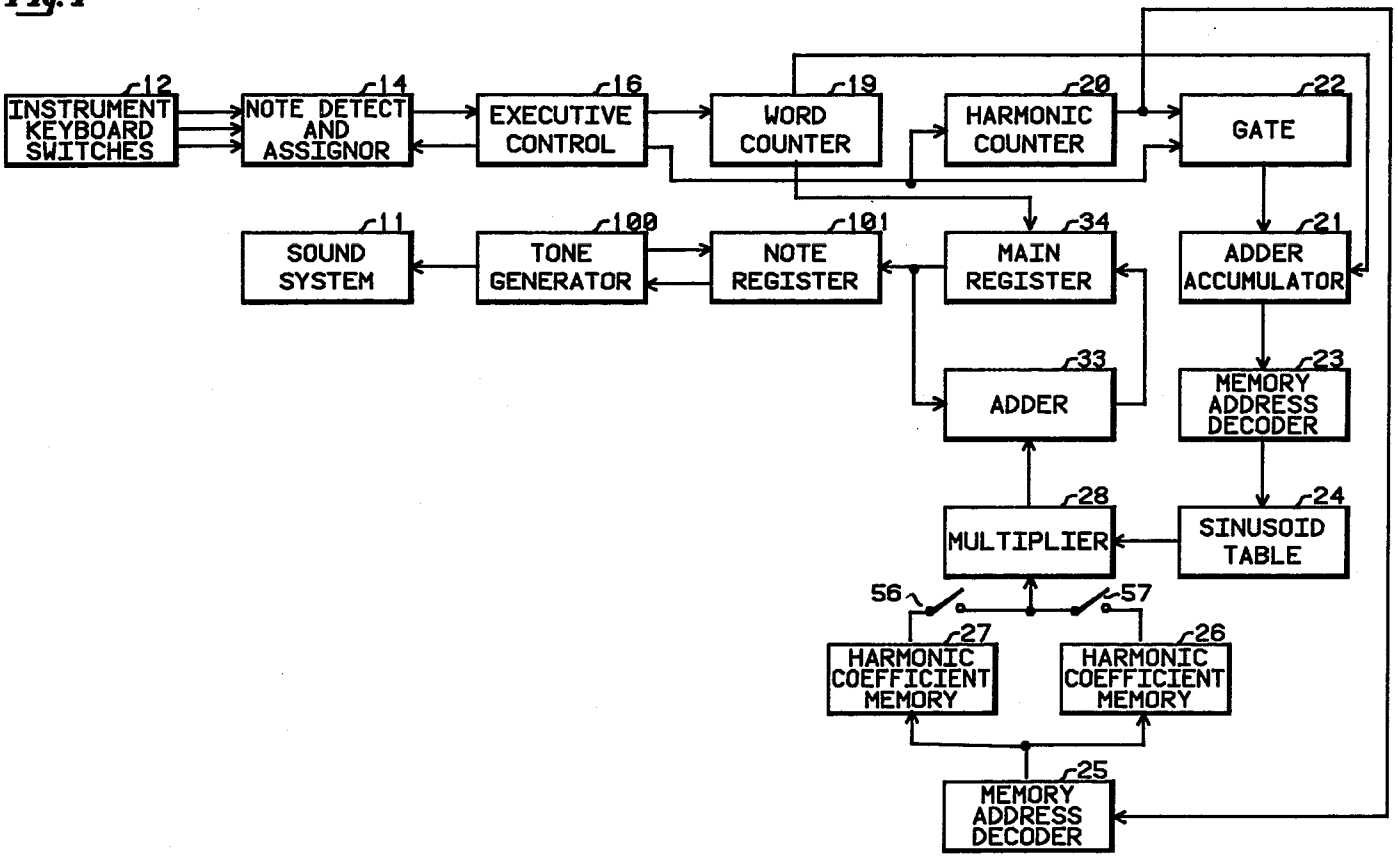
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard switches. The array is contained in the system block labeled keyboard switches 12. If one or more of the keyboard switches have a switch status change and are actuated ("on" position) on the instrument's keyboard, the note detect and assignor 14 stores the corresponding note information for the actuated keyswitches and one member of the set of tone generators 100 is assigned to each actuated keyswitch. A suitable note detect and assignor subsystem is described in U.S. Pat. No. 4,022,098 which is hereby incorporated by reference.

When one or more keyswitches on the keyboards have been actuated, the executive control 16 initiates a sequence of computation cycles. During each computation cycle, a master data set consisting of 64 data words is computed in a manner described below and stored in the main register 34. The 64 data words in the master data set are generated using 32 harmonic coefficients that are stored in the harmonic coefficient memories 26 and 27. The selection of a particular combination of harmonic coefficients is controlled by the setting of the tone switches 56 and 57. The tone switches are often called stops or stop switches.

The 64 data words in the master data set correspond to the amplitudes of 64 equally spaced points of one cycle of the audio waveform for the musical tone produced by the tone generators 100. The general rule is that the maximum number of harmonics in the audio tone spectra is no more than one-half of the number of data points in one complete waveshape period. Therefore, a master data set comprising 64 data words corresponds to a maximum of 32 harmonics.

At the completion of each computation cycle in the sequence of computation cycles, a transfer cycle is initiated during which the master data set residing in the main register 34 is transferred to the note register 101. The data words stored in the note register 101 are read out sequentially and repetitively and assigned to each of a number of tone generators in a manner described below. Data assigned to each tone generator is transferred to a digital-to-analog converter which converts the digital data words into an analog waveshape. The digital-to-analog converter is contained in the system block labeled sound system 11. The musical waveshape is transformed into an audible sound by means of a sound system consisting of a conventional amplifier and speaker subsystem which are also contained in the system block labeled sound system 11.

As described in the referenced U.S. Pat. No. 4,085,644 it is desirable to be able to continuously recompute and store the generated master data set during a sequence of computation cycles and to load this data into the note register while the actuated keys remain depressed on the keyboards. This system function is accomplished without interrupting the flow of data points to the digital-to-analog converter.

In the manner described in the referenced U.S. Pat. No. 4,085,644, the harmonic counter 20 is initialized at the start of each computation cycle. Each time that the word counter is incremented so that it returns to its initial state because of its modulo counting implementation, a signal is provided which increments the count state of the harmonic counter 20. The word counter 19 is implemented to count modulo 64 which is the number of data words in the master data set which is generated and stored in the main register 34. The harmonic counter 20 is implemented to count modulo 32. This number corresponds to the maximum number of harmonics consistent with a master data set comprising 64 words.

At the start of each computation cycle, the adder-accumulator 21 is initialized to a zero value. Each time that the word counter 19 is reset to its initial value, or minimal count state, the accumulator is reset to a zero value. Each time that the word counter 19 is incremented, the accumulator adds modulo 64 the current count state of the harmonic counter 20 to the sum already contained in the accumulator.

The content of the accumulator in the adder-accumulator 21 is used by the memory address decoder 23 to address out trigonometric sinusoid values from the sinusoid table 24. The sinusoid table 24 is implemented as a read only memory storing values of the trigonometric function sin $(2\pi\phi/64)$ for $0 \leq \phi < 64$ at intervals of D. D is a table resolution constant.

The multiplier 28 multiplies the trigonometric value read out of the sinusoid table 24 by harmonic coefficient values that are read out of the harmonic coefficient memories 26 and 27 in response to addresses provided by the memory address decoder 25. The memory address decoder 25 provides a memory address corresponding to the count state of the harmonic counter 20. Switches 56 and 57 are selectively actuated to determine the set of harmonic coefficients which are provided to the multiplier 28. The product value formed by the multiplier 28 is furnished as one input to the adder 33.

The contents of the main register 34 are initialized to a zero value at the start of a computation cycle. Each time that the word counter 19 is incremented, the contents of the main register 34 at an address corresponding to the count state of the word counter 19 is read out and furnished as an input to the adder 33. The sum of the inputs to the adder 33 are stored in the main register 34 at a memory location equal, or corresponding, to the count state of the word counter 19. After the word counter 19 has been cycled for 32 complete count cycles of 64 counts, the main register 34 will contain the master data set corresponding to the selected musical tone according to the actuation states of the tone switches, or stops, 56 and 57.

Figure 2:
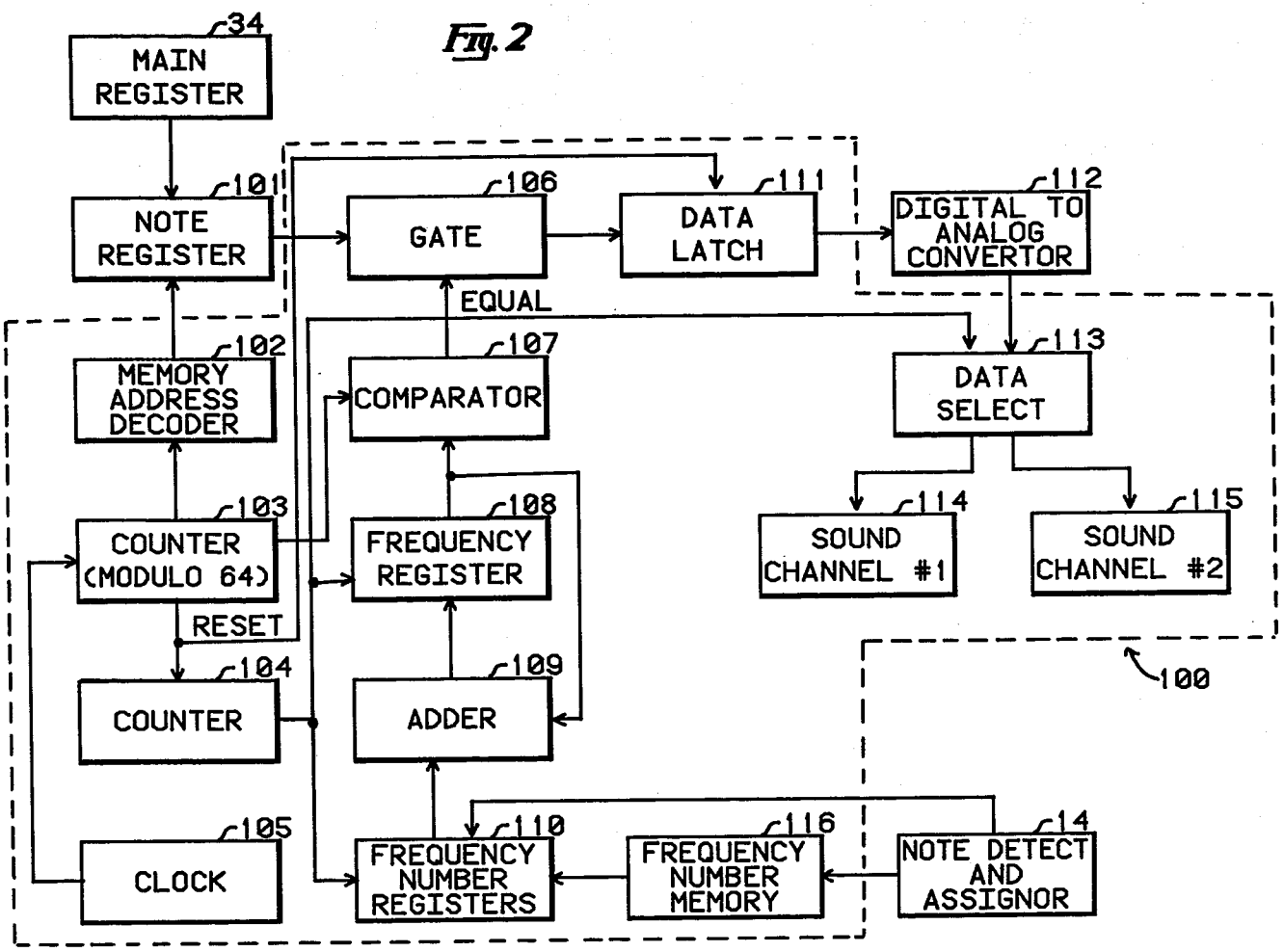
FIG. 2 is a schematic diagram of the tone generators.

FIG. 2 illustrates the logic details for assigning data read out of the note register to each of a number of tone generators. The logic enclosed by the dashed lines in FIG. 2 is contained in the tone generators 100.

The note detect and assignor 14 detects the keyswitch states on the musical instrument's keyboard. In response to a switch state change from an unactuated to an actuated switch state, the note detect and assignor 14 causes a corresponding frequency number to be addressed out of the frequency number memory 116.

The frequency number memory 116 is a read-only addressable memory containing words in binary form having values $2^{-(M-N)/12}$ where N has the range of values $N=1,2,\ldots,M$ and M is equal to the number of keyswitches on the musical instrument's keyboard. The frequency numbers represent the ratios of the fundamental frequencies in an equal tempered musical scale. A detailed description of the frequency numbers is contained in U.S. Pat. No. 4,114,496 entitled "Note Frequency Generator For A Polyphonic Tone Synthesizer" which is hereby incorporated by reference.

The frequency numbers read out of the frequency number memory 116 are stored in a frequency number register 110 at an address corresponding to a tone generator assigned to an actuated keyswitch by means of the note detect and assignor 14.

The clock 105 provides a source of timing signals which are used to increment the count state of the counter 103. The counter 103 is implemented to count modulo 64 which modulo member is equal to the number of words in the master data set that has been transferred to the note register 101.

The memory address decoder 102 addresses out master data set words from the note register 101 in response to the count states of the counter 103. The data read out from the note register 101 is furnished as an input data source to the gate 106.

The counter 104 is incremented by a RESET signal which is generated by counter 103 each time that counter 103 is incremented to return to its minimal count state because of its modulo counting implementation. The counter 104 is implemented to count modulo K. K is the number of tone generators contained in the tone generators 100.

In response to the count states of the counter 104, a frequency number is read out from the frequency number registers 110 for the register associated with the tone generator corresponding to the count state of the counter 104. Simultaneously an address number is read out from the frequency register 108 at an address corresponding to the count state of the counter 104. The frequency number read out from the frequency number registers 110 is added by means of the adder 109 to form a new address number. The new address number is stored in the frequency register 108 at an address location associated with the count state of the counter 104. The address number is also called an accumulated frequency number.

The combination of the adder 109 and the frequency register 108 functions in the known manner of the usual adder-accumulator used as an element of a frequency divider given the generic name of a non-integer frequency divider.

The comparator 107 compares the count state of the counter 103 with the 6 most significant bits of the current address number, or accumulated frequency number, read out from the frequency register 108. When the comparator 107 finds an equal condition between the compared values, an EQUAL signal is generated. This comparison is equivalent to examining the numerical difference between the count state of the counter 103 and the current address number and generating an EQUAL signal if the difference is less than a preselected comparison number.

In response to the EQUAL signal, the gate 106 transfers the current data value accessed from the note register 101 to the data latch 111. Each time that the counter 104 is incremented, the data value temporarily stored in the data latch 111 is transferred to the digital-to-analog converter 112. The converted analog signal is furnished to the data select 113.

The purpose of the data latch 111 is to provide data at equal time spacings to the digital-to-analog converter for each of the K tone generators. This is necessary because the time at which an EQUAL signal is generated by the comparator 107 is not fixed but varies as a function of the address numbers furnished by the frequency register 108.

The data select 113 transfers its input signal to one of the K sound channels which corresponds to the count state of the counter 104 minus one. The decrement of minus one is used because the data value contained in the data latch 111 corresponds to a sound channel for an immediate previous count state of the counter 104.

The required clock frequency f of the clock 105 can be computed from the expression $$f=f_oHKL \qquad \text{Eq. 1}$$

where $f_o$=highest fundamental musical frequency

H=maximum number of harmonics

L=2H.

Typically $f_o$=2093 hz, K=7 and H=32. The required clock frequency is then f=30 Mhz.

A reduction of a factor of two can be obtained for the computation cycle time, transfer cycle time, and the clock frequency f by employing waveshape symmetry as described in the referenced U.S. Pat. No. 4,085,644. If the elements $Z_j$; j=1,2, . . . , 64 of the master data set are generated, for example, with odd symmetry then $$Z_j=-Z_{65-j} \qquad \text{Eq. 2}$$

Figure 3:
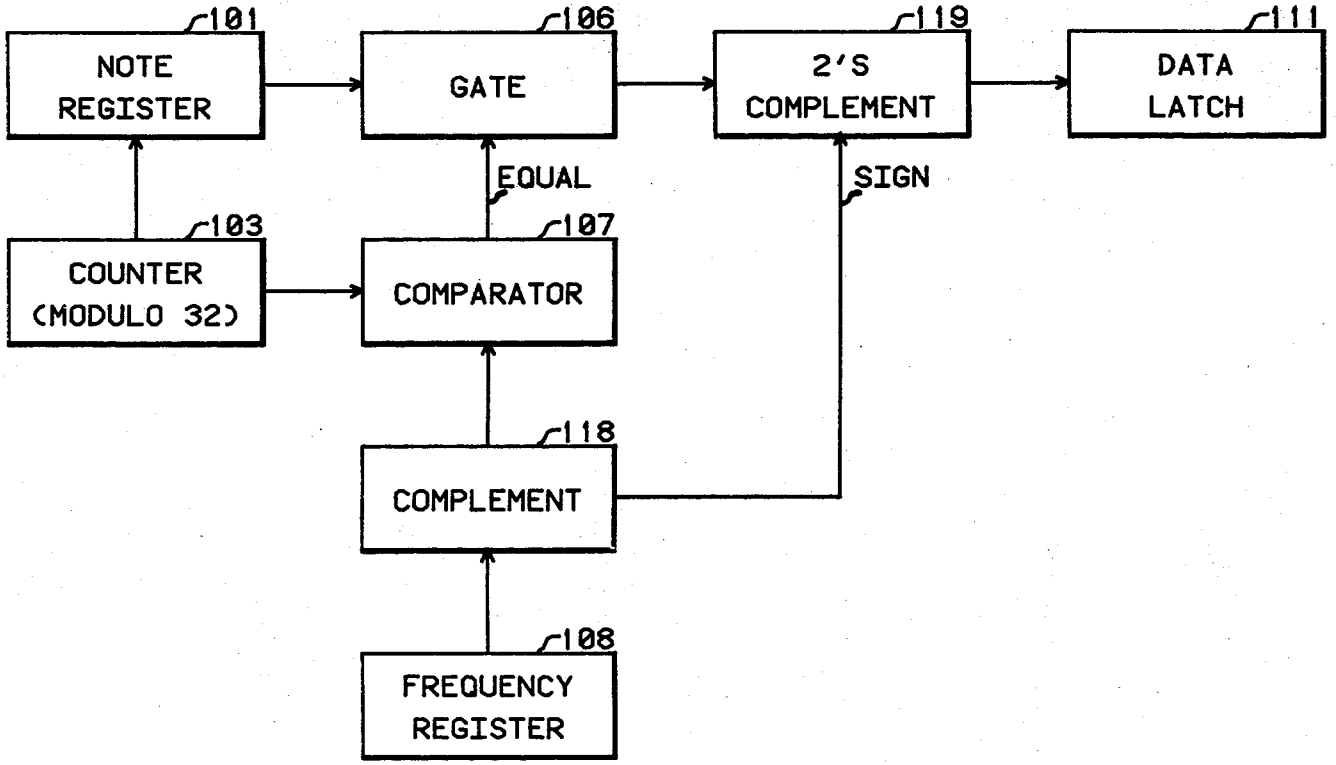
FIG. 3 is an alternative version of the tone generator logic using odd symmetry data points.

FIG. 3 illustrates a system alternative to the system shown in FIG. 2 that permits a reduction of one-half of the clock 105 frequency by exploiting the odd-symmetry of the master data set points. Only one half of the master data set points are computed during a computation cycle and stored in the main register 34. The master data set is transferred to the note register 101 during the transfer cycle.

In FIG. 3, the counter 103 is implemented to count modulo 32 which is equal to one-half of the number of data points for a complete period of the musical waveshape corresponding to the computed master data set.

If the decimal value equivalent of the five most significant bits of the address number m accessed out from the frequency register 108 is less than or equal to 32, then the complement 118 transfers the address number unaltered from the frequency number register 108 to the comparator 107. If the address number m accessed out from the frequency register 108 is greater than 32, then the complement 118 changes the address number to a complemented address number, or complemented frequency number, m-32. The complemented address number is transferred to the comparator 107 and a SIGN signal is generated. The complement 118 contains a comparator which determines whether or not a complemented address number is generated.

In response to the SIGN signal, the 2's complement 119 will perform a 2's complement operation on the data transferred by the gate 106 in response to an EQUAL signal generated by the comparator 107.

Another alternative, as described in the referenced U.S. Pat. No. 4,085,644, is to generate points of a master data set having an even symmetry. Even symmetry implies that $$Z_j=Z_{65-j} \qquad \text{Eq. 3.}$$

When even symmetric points are computed, the 2's complement 119 shown in FIG. 3 is not used and the data values transferred by the gate 106 are passed unaltered to the data latch 111.

An individual tone generator in the system shown in FIG. 2 comprises a register contained in the frequency number registers 110 and a sound channel. All the tone generators share the common elements of a frequency number memory 116, adder 109, comparator 107, gate 106, data latch 111, the digital-to-analog converter 112, and the data select 113.

Figure 4:
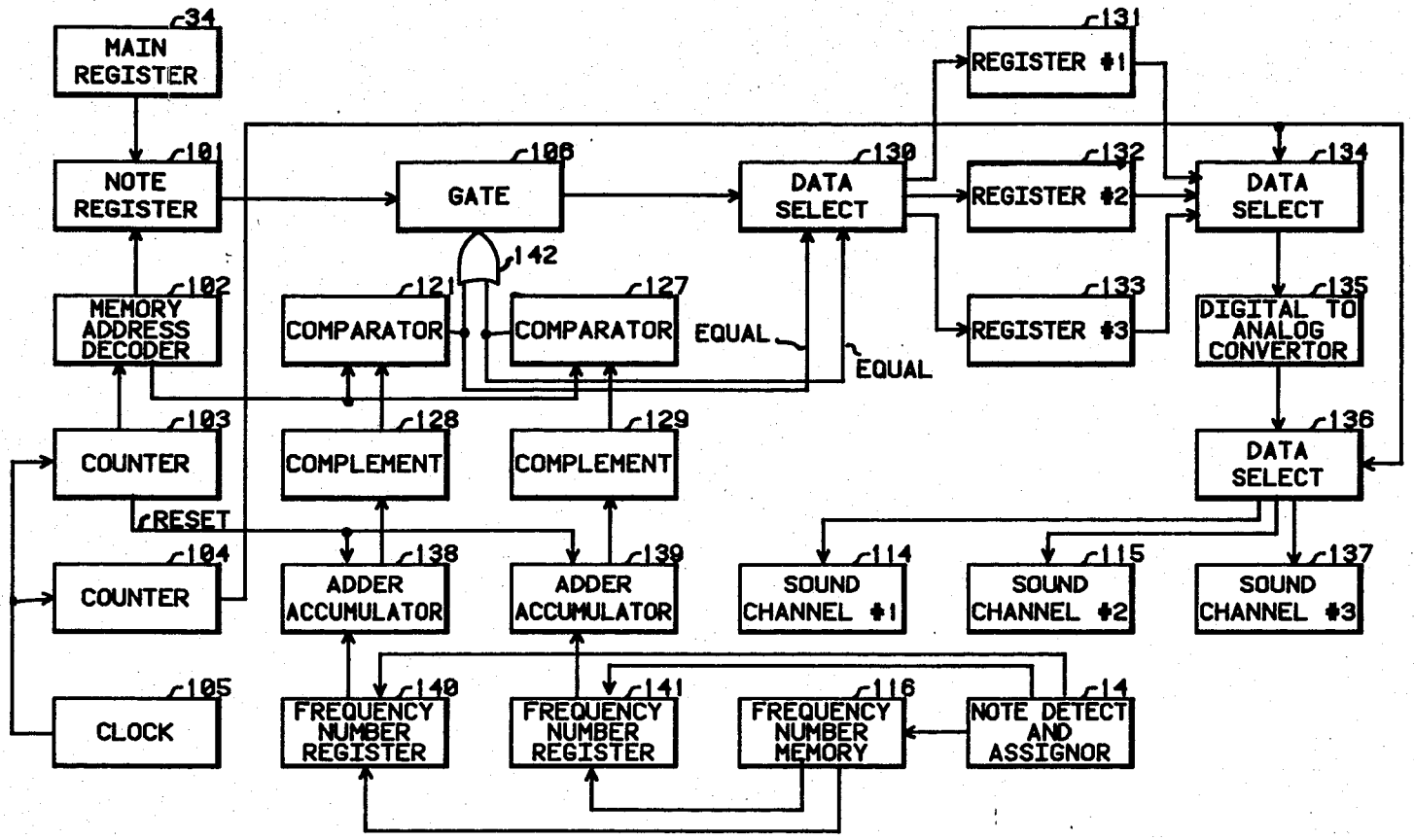
FIG. 4 is an alternative version of the invention.

An alternative version of the invention is shown in FIG. 4. An object of the alternative version is to reduce the frequency of the clock 105.

In response to actuated keyswitches, the note detect and assignor 14 reads out frequency numbers that are stored in the frequency number memory 116. The accessed frequency numbers are stored in a set of frequency registers which correspond to a similar number of tone generators. While only two frequency number registers 140 and 141 are shown explicitly in FIG. 2, it is understood that these symbolically represent a multiplicity of similar frequency number registers; one for each tone generator.

The master data set, comprising 32 data points, is computed with even symmetry during a computation cycle and stored in the main register 34. These 32 data points correspond to a half-period of a selected musical waveshape.

The counter 103 counts the clock signals produced by the clock 105. Counter 103 is implemented to count modulo 32. Each time that counter 103 is incremented so that it returns to its minimal count state, a RESET signal is generated. In response to the RESET signal, each one of the set of adder-accumulators 138–139 adds the frequency number contained in its corresponding frequency number register to the sum contained in its accumulator. There is an adder-accumulator associated with each of the frequency number registers.

The set of complementers 128–129 complement the first five bits of the data words contained in their associated adder-accumulators if the equivalent decimal values exceed 32 in the manner previously described for the system shown in FIG. 3.

Each of the set of comparators 121–127 will generate an EQUAL signal when the output of the first five bits from its associated complement is equal to the current address number provided by the memory address decoder 102. In response to any EQUAL signal the OR-gate 142 will cause the gate 106 to transfer the current data value read out of the note register to the data select 130.

When any of the comparators 121–127 generates an EQUAL signal, the data input to the data select 139 is transferred to one of the set of registers 131–133. The selection of one of these registers is determined so as to correspond to the comparator that generated the EQUAL signal. It is noted that the inventive system permits more than one comparator to simultaneously generate an EQUAL signal.

Counter 104 counts the clock signals produced by the clock 105. Counter 104 is implemented to count modulo K, where K is the number of tone generators. Counter 104 must reach a count state of K in the same time required for the counter 103 to reach a count state of 32. The count states are assumed to correspond to the decimal sequence 1,2, . . . k although the counter actually counts the binary sequence states 000 000, 000 001, . . . . Counter 104 can be implemented as a non-integer counter using an adder-accumulator in which a constant K/32 is added to itself for each clock timing pulse provided by the clock 105. The integer portion of the count state of the counter 104 is used by the data select 134 to direct the output from one of the registers 131–133 to the digital-to-analog converter 135.

The integer portion of the count state of the counter 104 is used by the data select 136 to direct the output signal from the digital-to-analog converter 135 to a corresponding sound channel in the set of sound channels.

The frequency of the clock 105 is set at the value $$f=f_oH^2 \qquad \text{Eq. 4}$$

where $f_o$ and H are defined in Eq. 1. For the typical system values of $f_o=2093$ hz and $H=32$, $f=2.14$ mhz. This value of f is well within the frequency limitations of current state-of-the-art microelectronic circuitry.

It is an obvious extension of the system shown in FIG. 4 to use a master data set computed with an odd-symmetry. The modification, similar to that shown in FIG. 3, is to insert a 2's complement means between the gate 106 and the data select 130.

Figure 5:
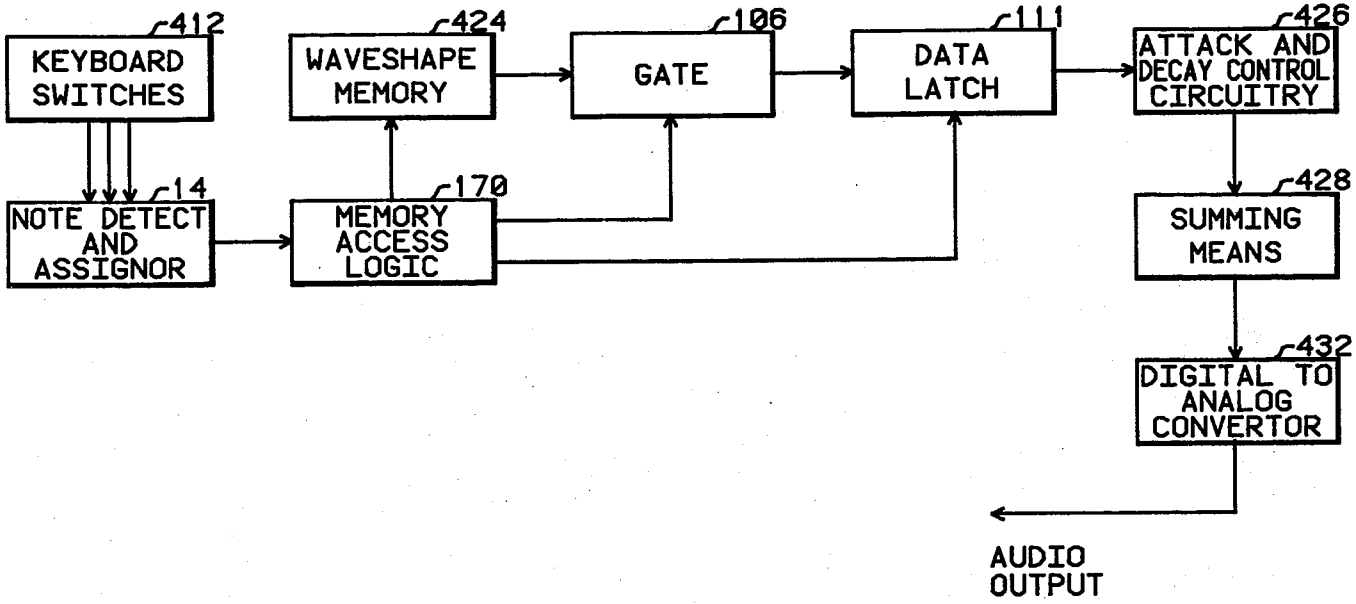
FIG. 5 shows a version of the invention used for a waveshape in memory tone generator.

FIG. 5 illustrates an application of the invention to a tone generation system of the generic class called waveshape in memory. Such a tone generation system is described in U.S. Pat. No. 3,515,792 which is hereby incorporated by reference. The system blocks shown in FIG. 5 are numbered to be 400 plus the corresponding block numbers shown in FIG. 1 of the referenced patent.

The waveshape memory 424 is used to store a set of data points defining a complete cycle of the selected musical tones. The memory access logic 170 details are shown in FIG. 2 and its operation has been previously described. The remainder of the system is the same as that of the referenced patent.

We claim:

1. In a keyboard musical instrument, having a keyboard array of keyswitches, in which a plurality of data words corresponding to the amplitudes of points defining the waveform of a musical tone are computed during a computation cycle and transferred sequentially to be converted into musical waveshapes, apparatus for producing a plurality of musical tones at frequencies corresponding to actuated keyswitches comprising;

a coefficient memory means for storing a set of harmonic coefficients, a first addressing means for reading out said set of harmonic coefficients, a waveshape memory means, a means for computing responsive to said read out set of harmonic coefficients whereby said plurality of data words corresponding to said amplitudes of points defining the waveform of a musical tone are computed and stored in said waveshape memory means during a computation cycle, a frequency number means for generating a frequency number in response to a detect signal, a keyswitch state detect means wherein said detect signal is generated in reponse to each actuated keyswitch in said keyboard array of keyswitches, a first adder-accumulator means wherein each said generated frequency number is successively added to the contents of an accumulator to form an accumulated frequency number, a second addressing means for sequentially reading out data words stored in said waveshape memory means at a constant rate, a selection gate means responsive to said accumulated frequency number whereby data words read out from said waveshape memory means are selected, and a means for producing musical waveshapes during a computation cycle from data words selected by said selection gate means thereby generating said plurality of musical tones.

2. In a musical instrument according to claim 1 wherein said adder-accumulator means comprises;

a plurality of first number registers each of which stores a frequency number generated by said frequency number means, a plurality of second number registers, each of which is associated with a corresponding one of said plurality of first number registers, and wherein each one of said plurality of second number registers stores an accumulated frequency number, a third addressing means for sequentially accessing a frequency number from each one of said plurality of first number registers and for sequentially accessing an accumulated frequency number from each corresponding one of said plurality of second number registers, and a first adder means for adding each said accessed frequency number from said plurality of first number registers with each said corresponding accumulated frequency number accessed from said plurality of second number registers to form a new value of an accumulated frequency number and whereby said new value is stored in a corresponding one of said plurality of second number registers.

3. In a musical instrument according to claim 1 wherein said frequency number means comprises;

a frequency number memory means for storing a set of frequency numbers, and an addressing means responsive to each said detect signal whereby a corresponding frequency number is read out from said frequency number means.

4. In a musical instrument according to claim 2 wherein said second addressing means comprises;

a clock for providing timing signals, a first counter for counting said timing signals modulo the number of said plurality of data words corresponding to said amplitudes of points defining the waveform of a musical tone and wherein a count reset signal is generated each time that the count state of said first counter returns to its minimal count state, and a memory accessing means responsive to the contents of said first counter for reading out data stored in said waveshape memory means.

5. In a musical instrument according to claim 4 wherein said selection gate means comprises;

a data latch memory means, a comparator means responsive to the contents of said first counter and each said accumulated frequency number accessed from said plurality of second number registers whereby an equal signal is generated if the numerical difference between said contents of said first counter and said accumulated frequency number is less than a preselected comparison number, and an inhibit gate interposed between said waveshape memory means and said data latch memory means whereby said data words read out from said waveshape memory means are stored in said data latch memory means in response to said equal signal.

6. In a musical instrument according to claim 5 wherein said means for producing musical waveshapes comprises;

a second counter for counting each said count reset signal modulo the number of said plurality of musical tones, a latch addressing means responsive to said count reset signal whereby the data value stored in said data latch means is read out, and a conversion means responsive to said count reset signal wherein said data value read out from said data latch means is converted into an analog signal.

7. In a musical instrument according to claim 6 wherein said means for producing musical waveshapes further comprises;

a plurality of audio amplifier means each of which corresponds to one of said plurality of musical tones, and a data select means responsive to the count state of said second counter whereby the analog signal produced by said conversion means is transferred to one of said plurality of audio amplifier means.

8. In a musical instrument according to claim 1 wherein said means for computing comprises;

a logic clock means for providing logic timing signals, a word counter for counting said logic timing signals modulo the number of said plurality of data words stored in said waveshape memory means, a harmonic counter incremented each time said word counter returns to its minimal count state, a second adder-accumulator means wherein the count state of said harmonic counter is successively added to the content of an accumulator in response to said logic timing signals and wherein the content of said accumulator is initialized to a zero value at the start of a computation cycle, a sinusoid table storing a set of trigonometric function values, a sinusoid table addressing means responsive to the content of said second adder-accumulator means for reading out a trigonometric function value from said sinusoid table, a multiplying means for multiplying said read out trigonometric function value by one of said read out set of harmonic coefficients to form an output product data value, and a means for successively summing said output product data value with data words read out from said waveshape memory means and whereby the summed value is stored in said waveshape memory means.

9. In a keyboard musical instrument having a keyboard array of keyswitches, in which points defining the waveform of a musical tone are stored in a waveshape memory and are read out sequentially and converted into musical waveshapes, apparatus for producing a plurality of musical tones at frequencies corresponding to actuated keyswitches comprising;

a waveshape memory means for storing a set of data words defining the waveform of a musical tone, a frequency number means for generating a frequency number in response to a detect signal, a keyswitch state detect means wherein said detect signal is generated in response to each actuated keyswitch in said keyboard array of keyswitches, a first addressing means for sequentially reading out data words stored in said waveshape memory means at a constant rate, a selection gate means responsive to each said generated frequency number whereby data words read out from said waveshape memory means are selected, and a means for producing musical waveshapes from data words selected by said selection gate means thereby generating said plurality of musical tones.

10. In a musical instrument according to claim 9 wherein said selection gate means comprises;

a plurality of first number registers each of which stores a frequency number generated by said frequency number means, a plurality of second number registers, each of which is associated with a corresponding one of said plurality of first number registers, and wherein each one of said plurality of second number registers stores an accumulated frequency number, a second addressing means for sequentially accessing a frequency number from each one of said plurality of first number registers and for sequentially accessing an accumulated frequency number from each corresponding one of said plurality of second number registers, and a first adder means for adding each said accessed frequency number from said plurality of first number registers with each said corresponding accumulated frequency number accessed from said plurality of second number registers to form a new value of an accumulated frequency number and whereby said new value is stored in a corresponding one of said plurality of second number registers.

11. In a musical instrument according to claim 10 wherein said first addressing means comprises;

a clock for providing timing signals, a first counter for counting said timing signals modulo the number of data words stored in said waveshape memory means wherein a count reset signal is generated each time that the count state of said first counter returns to its minimal count state, and a memory accessing means responsive to the contents of said first counter for reading out data stored in said waveshape memory means.

12. In a musical instrument according to claim 11 wherein said selection gate means comprises;

a data latch memory means, a comparator means responsive to the contents of said first counter and each said accumulated frequency number accessed from said plurality of second number registers whereby an equal signal is generated if the numerical difference between said content of said first counter and said accumulated frequency number is less than the value of a preselected comparison number, and an inhibit gate responsive to said equal signal whereby said data words read out from said waveshape memory means are stored in said data latch memory means.

13. In a musical instrument according to claim 12 wherein said means for producing musical waveshapes comprises;

a second counter for counting each said count reset signal modulo the number of said plurality of musical tones, a latch addressing means responsive to said count reset signal whereby the data word stored in said data latch memory means is read out, and a conversion means responsive to said count reset signal whereby said data value read out from said data latch means is converted into an analog signal.

14. In a musical instrument according to claim 13 wherein said means for producing musical waveshapes further comprises;

a plurality of audio amplifier means each of which corresponds to one of said plurality of musical tones, and a data select means responsive to the count state of said second counter whereby the analog signal produced by said conversion means is transferred to one of said plurality of audio amplifier means.

15. In a musical instrument according to claim 11 wherein said waveshape memory means stores a set of data words defining one half period of a waveform of a musical tone having odd symmetry about the half period data word value and wherein said selection gate means comprises;

a data latch memory means, a frequency number complement means responsive to each said accumulated frequency number accessed from said plurality of second number registers wherein a complemented frequency number is generated having a value equal to said accumulated frequency number if the value of said accumulated frequency number is no greater than the total number N of said set of data words stored in said waveshape memory and wherein a complemented frequency number is generated having a value equal to the difference value of the accumulated frequency number and the total number N of said set of data words stored in said waveshape memory, a comparator means responsive to the contents of said first counter and said complemented frequency number whereby an equal signal is generated if the numerical difference between said content of said first counter and said complemented frequency number is less than the value of a preselected comparison number, an inhibit gate responsive to said equal signal for selecting a data word read out from said waveshape memory means, and a data complement means whereby the data word selected by said inhibit gate is transferred unaltered and stored in said data latch memory means if said accumulated frequency number is no greater than said number N and whereby the data word selected by said inhibit gate is transformed to its equivalent binary 2's complement form and stored in said data latch memory means if said accumulated frequency number is greater than said number N.

16. In a musical instrument according to claim 11 wherein said waveshape memory means stores a set of data words of number N defining one half period of a waveform of a musical tone having even symmetry about the half period data word value and wherein said selection gate means comprises;

a data latch memory means, a frequency number complement means responsive to each said accumulated frequency number accessed from said plurality of second number registers wherein a complemented frequency number is generated having a value equal to said accumulated frequency number if the value of said accumulated frequency number is no greater than said number N and wherein a complemented frequency number is generated having a value equal to the difference value of the accumulated frequency number and said number N, a comparator means responsive to the contents of said first counter and said complemented frequency number whereby an equal signal is generated if the numerical difference between said content of said first counter and said complemented frequency number is less than the value of a preselected comparison number, and an inhibit gate responsive to said equal signal transferring a data word read out from said waveshape memory means to be stored in said data latch memory means.

17. In a musical instrument according to claim 11 wherein said selection gate means comprises;

a plurality of first number registers each of which stores a frequency number generated by said frequency number means, a plurality of second number registers, each of which is associated with a corresponding one of said plurality of first number registers, and wherein each one of said plurality of second number registers stores an accumulated frequency number, and a plurality of adder means, responsive to said count reset signal, whereby the frequency number stored in each one of said plurality of first number registers is added to the accumulated frequency number in the corresponding one of said plurality of second number register and the summed value is stored in said corresponding one of said plurality of second number registers.

18. In a musical instrument according to claim 17 wherein said selection gate means comprises;

a plurality of data latch memory means each of which is associated with a corresponding one of said plurality of first number registers, a plurality of comparator means, each of which is associated with a corresponding one of said plurality of first number registers, whereby each one of said comparator means generates an equal signal if the numerical difference between the content of said first counter and the accumulated frequency number stored in the corresponding one of said plurality of second number registers is less than the value of a preselected comparison number, and an inhibit gate responsive to each said equal signal whereby said data words read out from said waveshape memory means are stored in said plurality of data latch memory means.

19. In a musical instrument according to claim 18 wherein said means for producing musical waveshapes comprises;

a second counter for counting said timing signals modulo a number P where P is the number of data words in said set of data words defining a musical tone divided by the number of said plurality of musical tones, a data latch adding means responsive to said count reset signal whereby the data word stored in one of said plurality of data latch memory means corresponding to the content of said second counter is read out, and a conversion means comprising a digital-to-analog converter for converting said read out data word into an analog signal.

20. In a musical instrument according to claim 19 wherein said means for producing musical waveshapes further comprises, a plurality of audio amplifier means each of which corresponds to one of said plurality of musical tones, and a data select means responsive to the count state of said second counter whereby the analog signal converted by said conversion means is transferred to one of said plurality of audio amplifier means.

* * * * *